US005953825A

United States Patent [19]

Christman et al.

[11] Patent Number: 5,953,825

[45] Date of Patent: Sep. 21, 1999

[54] SAFETY RAZORS

[75] Inventors: Thomas A. Christman, Lexington, Mass.; Christopher Martin Hawes, Reading, United Kingdom

[73] Assignee: The Gillette Company, Boston, Mass.

[21] Appl. No.: 09/119,080

[22] Filed: Jul. 14, 1998

Related U.S. Application Data

[63] Continuation of application No. PCT/GB97/00121, Jan. 16, 1997.

[30] Foreign Application Priority Data

Jan. 16, 1996 [GB] United Kingdom ..... 9600818

[51] Int. Cl.[6] ..... B26B 21/52

[52] U.S. Cl. ..... 30/527; 30/50

[58] Field of Search ..... 30/47, 50, 527, 30/526, 62

[56] References Cited

U.S. PATENT DOCUMENTS

| | | | |
|---|---|---|---|
| 1,015,575 | 1/1912 | Meyer | 30/527 |
| 1,423,414 | 7/1922 | Glaser | 30/534 |
| 3,311,975 | 4/1967 | DeLonguyon | 30/62 |
| 3,374,540 | 3/1968 | De Longuyon | 30/62 |
| 4,347,663 | 9/1982 | Ullmo | 30/47 |
| 5,029,391 | 7/1991 | Althaus et al. . | |
| 5,038,472 | 8/1991 | Iderosa | 30/527 |
| 5,050,301 | 9/1991 | Apprille . | |
| 5,787,593 | 8/1998 | Althaus | 30/527 |

FOREIGN PATENT DOCUMENTS

| | | |
|---|---|---|
| 61-54433 | 5/1983 | Japan . |
| 2-52694 | 2/1990 | Japan . |
| 246 324 | 9/1947 | Switzerland . |
| 2 031 782 | 4/1980 | United Kingdom . |
| 2 116 470 | 9/1983 | United Kingdom . |
| 2172236 | 9/1986 | United Kingdom . |
| WO 89/01394 | 2/1989 | WIPO . |
| WO 93/20983 | 10/1993 | WIPO . |

*Primary Examiner*—Hwei-Siu Payer
*Attorney, Agent, or Firm*—Charles P. Boukus, Jr.; Edward S. Podszus

[57] ABSTRACT

In a safety razor, a blade assembly (2; 22; 52) is mounted to a handle by a mounting arrangement including several spring devices (8; 28: 68; 70) adapted so that the blade assembly is movable relative to the handle with several degrees of freedom, including pivotal movement about a longitudinal axis, pivotal movement about a transverse axis and translational movement in a downward direction substantially perpendicular to the plane defined by these axes. The longitudinal and transverse pivotal axes are not fixed in position and are variably located due to the spring suspension, allowing the blade assembly to follow closely the contours of a skin area being shaved.

9 Claims, 3 Drawing Sheets

SAFETY RAZORS

This is a continuation of International Application No. PCT/GB97/00121, with an international filing date of Jan. 16, 1997.

This invention relates to safety razors and is particularly concerned with safety razors of a form including a handle and a blade assembly mounted to the handle by an arrangement permitting movement of the blade assembly relative to the handle. In the embodiments of the invention described herein the blade assembly includes at least one elongate blade with a sharpened edge located between guard and cap surfaces, and a frame supporting the blade(s). However, the invention is also applicable to razors having foils with apertures provided with sharpened edges, rather than elongate blades.

There have been various proposals for mounting a blade assembly on a handle to allow movement of the blade assembly with the intention of maintaining conformity of the skin contacting parts with the skin surface during shaving. For example, many razors currently marketed have blade assemblies which are pivotable about a longitudinal axes. In our prior patent application No. GB-A-2116470, there is described a razor in which the blade assembly is also pivotable about a transverse axis. With the known constructions, however, the ability of the blade assembly to follow the skin contours is restricted by the limited degrees of freedom of the permitted movement of the blade assembly relative to the handle.

In accordance with the present invention there is provided a razor of the form as initially described above wherein the blade assembly is mounted to the handle by an arrangement comprising several spring suspension devices disposed to provide support for the blade assembly at discrete locations so distributed that the blade assembly is moveable relative to the handle with several degrees of freedom including pivotal movement about a longitudinal axis, pivotal movement about a transverse axis, and translational movement in a downward direction substantially perpendicular to the plane defined by said longitudinal and transverse axes.

The additional freedom of movement that can be provided by an independent spring suspension system enables the blade assembly to follow more closely the contours of an area of skin being shaved. In particular the longitudinal pivotal axis and transverse pivotal axes are not fixed at predetermined positions and they are variably located due to the independent suspension devices. In the case of a blade assembly incorporating one or more elongate blades, movements of the blade assembly in the longitudinal direction and in the rearward direction are undesirable and the suspension devices can be adapted to hold the blade assembly firmly against translational movements in these directions.

The exact number of spring suspension devices employed is not critical, but three being the minimum. It is preferable for the suspension devices to be so arranged that two of the support locations are spaced lengthwise of the blade assembly and a further support location is spaced transversely from an axis connecting said two support locations. Conveniently four suspension devices are provided and are located in oppositely disposed pairs, e.g. adjacent the respective corners of a frame of the blade assembly. The devices may consist of springs, such as integrally moulded plastic springs, bow springs or wire torsion springs, or may comprise struts with associated coil compression springs.

The invention is applicable to razors having permanently mounted blade assemblies, and to razors with blade assemblies in the form of replaceable cartridges. In the latter case, the suspension devices could be incorporated with the cartridge and have detachable connections to the handle, or they may be fixed to the handle and either detachably coupled directly to the cartridge or connected to a cartridge carrying member with which the cartridge is releasably engageable, such as by a sliding connection in a manner known per se.

Some particular embodiments of the invention are described below with reference to the accompanying drawings, in which.

Figure 1:
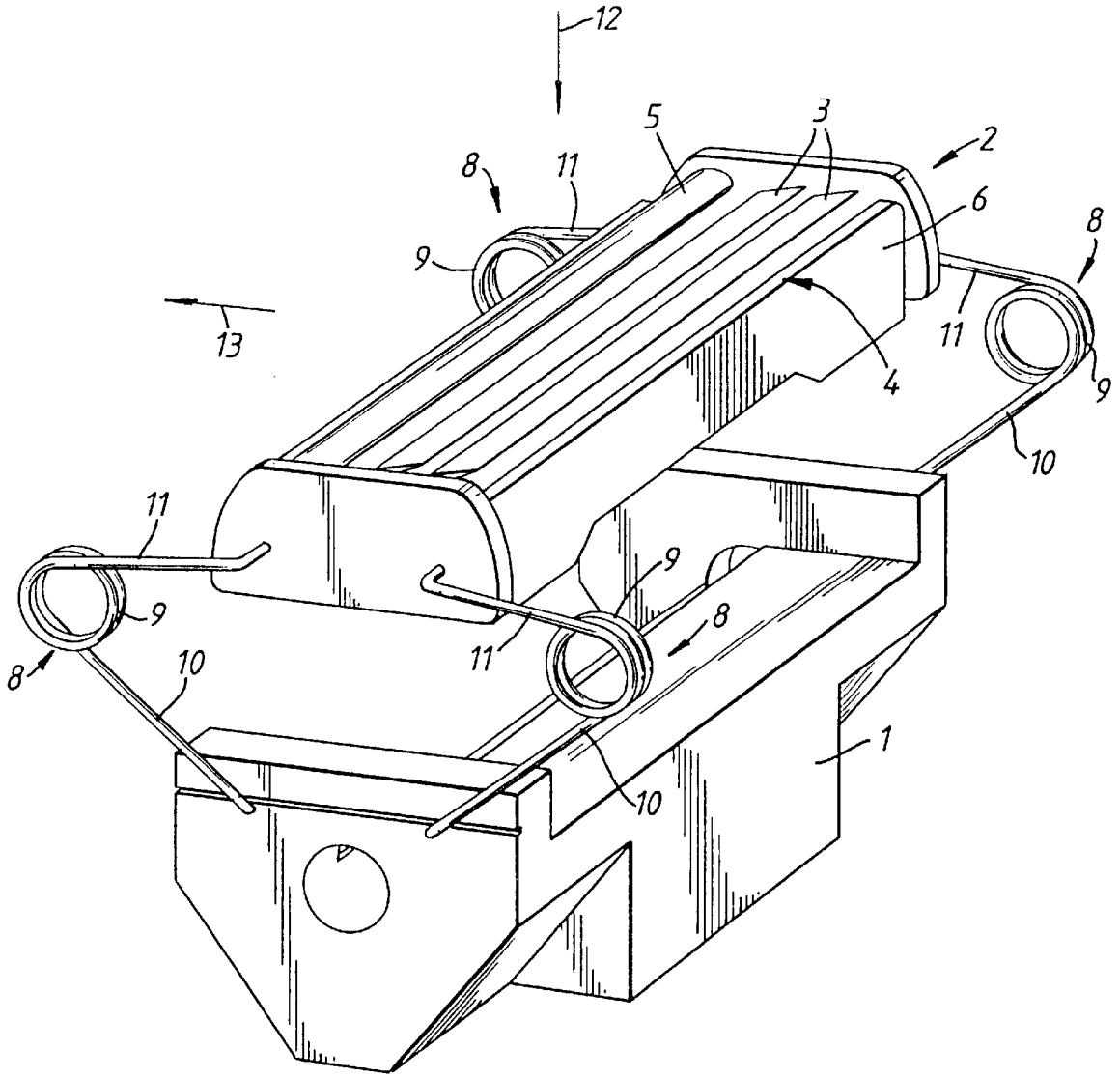
FIG. 1 shows in perspective a first embodiment of the invention.

FIG. 1 illustrates the upper part of a razor equipped with an independent suspension system in accordance with the invention. Only the upper portion 1 of the razor handle is shown, the lower portion, by means of which the handle is gripped in the hand, having being omitted as it is unimportant to the inventive concept. Mounted to the upper handle portion is a cartridge 2 having a generally rectangular frame 6 in which a pair of elongate blades 3 with parallel edges positioned in tandem are mounted between guard and cap surfaces 4 and 5 respectively.

The blades 3 may be fixedly mounted in the cartridge frame 6, or they may be movable, e.g. downwardly against restoring forces exerted by return spring elements as known in the art. The cartridge 2 is connected to the upper handle portion 1 by four independent suspension devices respectively coupled to the cartridge adjacent the corners of the cartridge frame. Each of the suspension devices consists of a wire torsion spring 8 having a coiled section 9 with two arms 10, 11 extending away from the coil at an acute angle with respect to each other. The free ends of the arms 10, 11 are respectively coupled to the handle and the cartridge for pivotal movement about axes directed longitudinally of the cartridge. Conveniently, inwardly bent arm portions are inserted rotatably in holes provided in the ends of the upper handle portion and the cartridge. The suspension springs 8 bias the cartridge to a rest position in which the cartridge is positioned relative to the handle as shown in FIG. 1. By virtue of the cartridge being independently and resiliently supported at four discrete points it has several degrees of freedom for movement relative to the handle. In particular, the cartridge can move from the rest position under forces exerted on the cartridge during use by:

a) translational movement in the downward direction, indicated by arrow 12;

b) a downward displacement of the front part, or the rear part, of the cartridge resulting in an effective pivotal movement about an axis extending longitudinally of the cartridge; and c) a downward displacement of either end of the cartridge resulting in an effective pivotal movement or tilting about a transverse axis.

Of course these movements are not necessarily distinct and they can occur in any combinations enabling the guard and cap surfaces to follow closely the contours of the skin area over which they pass during shaving. The cartridge 2 is not constrained to pivot about predetermined longitudinal and transverse axes fixed relative to the razor handle, but the suspension springs 8 allow the cartridge 2 to float so that the effective positions of the pivotal axes are variable. The extent of permitted movement does not need to be great.

One direction in which the cartridge 2 is held firmly against movement by the torsion springs 8 is longitudinally of the cartridge, i.e. parallel to the blade edges. Also, translational movement in the rearward direction indicated by arrow 13 is also resisted, as is rearward displacement of either end of the cartridge 2 which would result in an effective pivotal or yaw movement about an axis extending in the downward direction.

Figure 2:
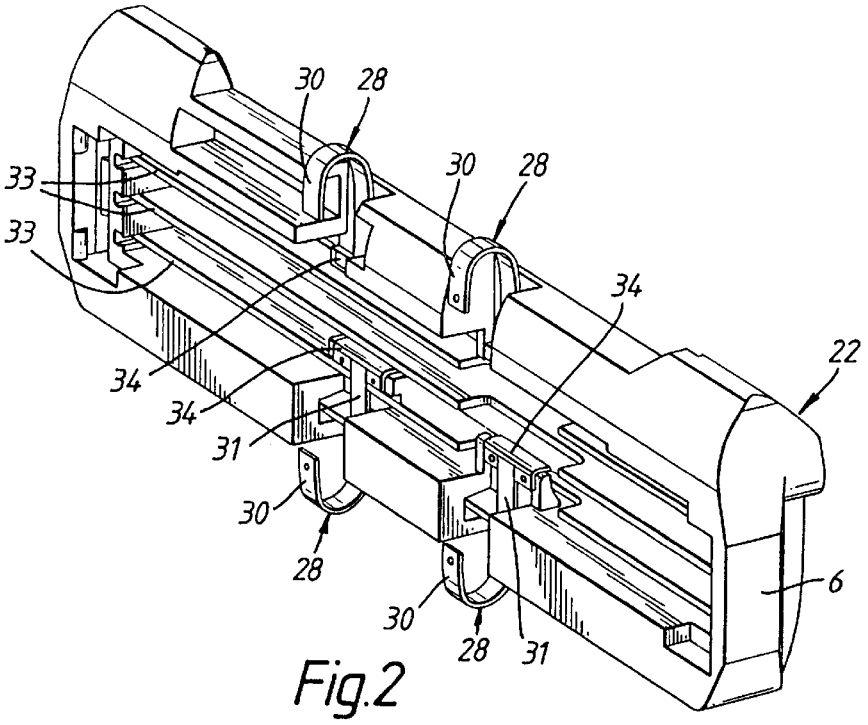
FIG. 2 is an underneath perspective view of a shaving cartridge according to a second embodiment of the invention.
Figure 3:
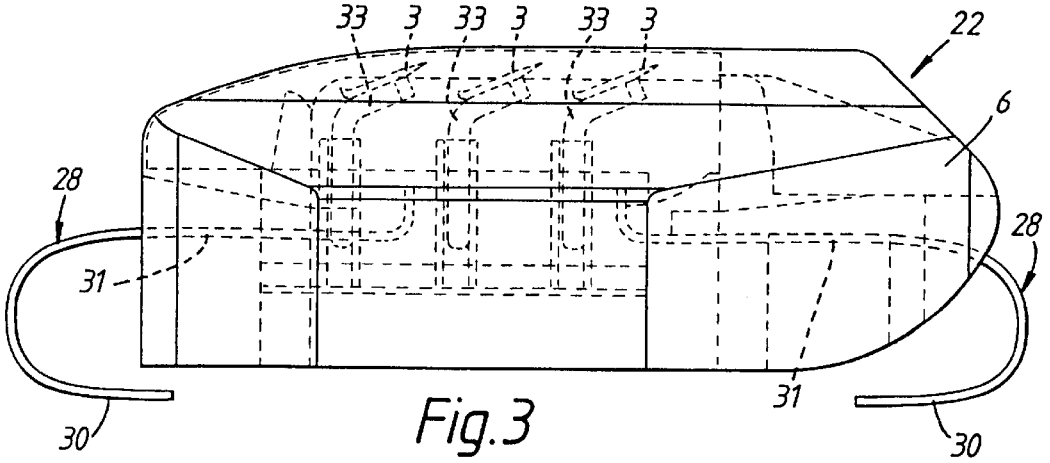
FIG. 3 shows the cartridge of FIG. 2 in end view and on an enlarged scale.

In the second embodiment illustrated in FIGS. 2 and 3, the independent suspension devices consist of four bow springs 28 arranged in opposed pairs. The cartridge 22 includes a frame 6, in this case with three blades 3 carried on blade carriers 33 guided for movement in slots in the end walls of the frame 6, and urged upwardly by springs 28. The upper arm 31 of each bow spring 28 has an L-shaped free end held firmly connected to the cartridge frame by a clamp 34. As may be seen clearly in FIG. 2, the front and rear frame elements are provided with notches through which the upper arms 31 of the bow springs 28 pass freely. The free ends of the lower arms 30 of the bow springs 28 form attachment points for connection to the razor handle, e.g. by a clamp arrangement which could be releasable to facilitate replacement of the cartridge 22 with attached suspension springs.

It will be understood that although the bow springs 28 are located nearer the centre of the cartridge 22 than the ends, they provide for substantially the same freedom of movement of the cartridge 22 relative to the handle as described above in relation to the first embodiment. In particular, the translational and angular movements (a) to (c) explained above are permitted.

Figure 4:
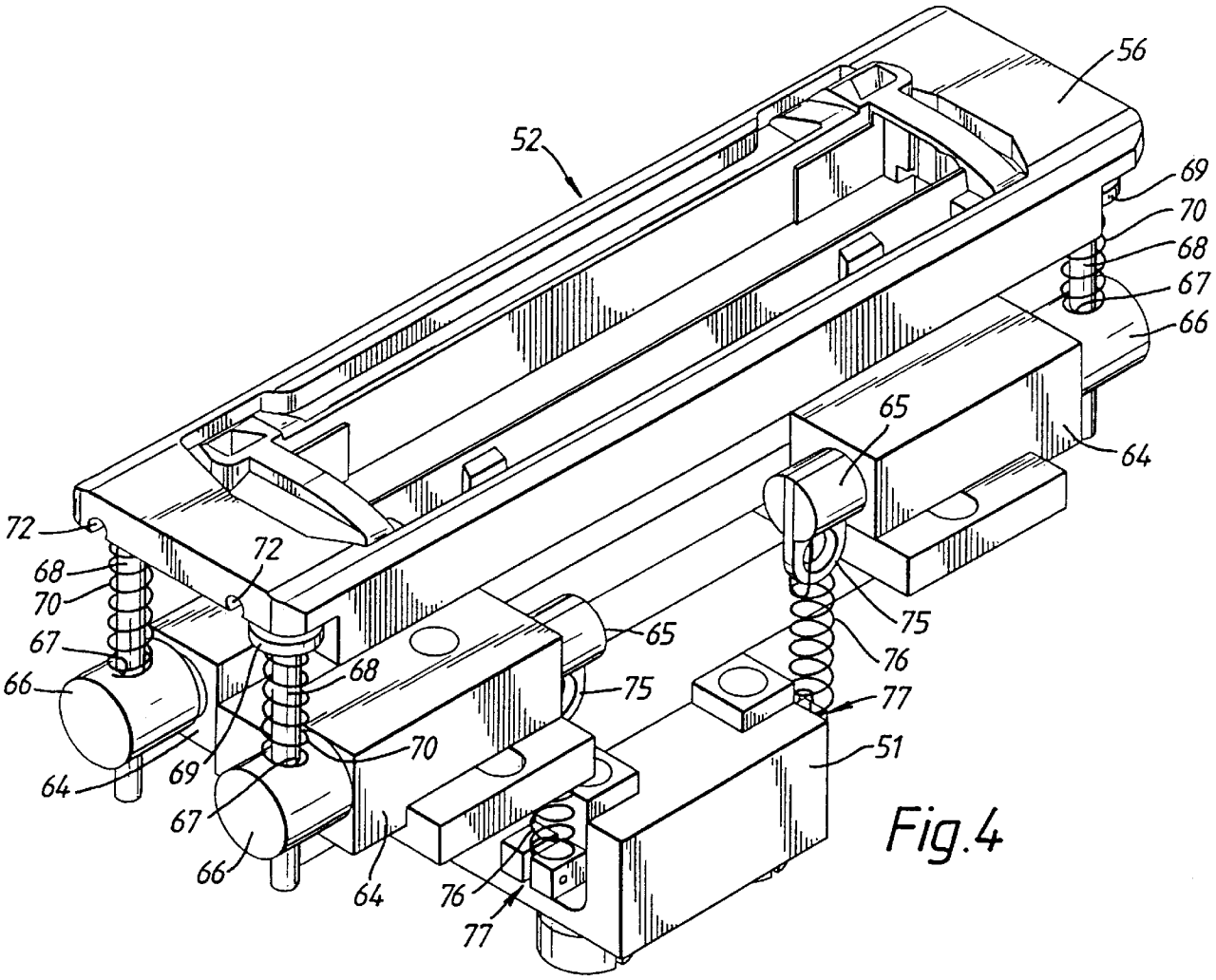
FIG. 4 is a perspective view of the third embodiment of the invention.

In FIG. 4 there is shown an embodiment of the invention in which the upper portion 51 of the handle includes four bearing blocks 64 with longitudinal bores in which axle pins 65 are rotatably received. The axle pins 65 have enlarged heads 66 at their outer ends with transverse through bores 67. Generally upright struts 68 are slidably guided in the bores 67 and are provided near their upper ends with flanges 69 which act as stops for the upper ends of coil springs 70 to act against, the springs 70 being coaxially mounted on the struts 68 and having their lower ends resting on the axle pins 65. Thus, the springs 70 urge the struts 68 upwardly to a rest position in which enlargements or stop elements (not shown) provided on the lower ends of the struts 68 abut against the enlarged heads 66 of the axle pins. The upper end of each strut 68 is rotatably and pivotally connected to the frame 56 of the blade assembly or cartridge 52. (Only the frame of the blade assembly is shown in FIG. 1, but it will be understood that it will include at least one elongate blade as well as guard and cap surfaces as in the previous embodiments.) Conveniently each strut 68 has an element, e.g. a ball fastened to its upper end and received in a complementary slot 72 extending inwardly from the adjacent end of the cartridge frame 56. At least one pair of longitudinally aligned axle pins 65, and possibly both pairs, have eye members 75 keyed to their inner ends and relatively strong tension springs 76 are connected between these eye members 75 and spring anchorages 77 fixed on the upper handle portion 51 for the tension springs 76 to bias the axle pins 65 to the illustrated rotational positions in which the struts 68 are substantially upright.

The independent spring suspension devices of the razor of FIG. 4 enable the cartridge 52 to move away from the rest position to which it is biased by virtue of the springs 70, 76, with the same freedoms of movement (a) to (c) described with reference to FIG. 1. Downward displacement at each corner of the cartridge 52 is permitted by the spring 70 and associated slidably guided strut 68 located adjacent that corner. A small degree of angular movement of the struts 68 is permitted by rotation of the axle pins 65 about their axes against the bias of the tension springs 76, such angular movement being necessary to allow the cartridge 52 to pivot about a longitudinal axis. The springs 76 are strong enough to resist rearward movement of the cartridge 52 under forces normally encountered during shaving. Longitudinal movement of the cartridge 52 is prevented by abutment between the cartridge frame 56 and the struts 68.

It will be understood that the illustrated razors are exemplary embodiments of the invention and other independent suspension systems are also possible which can provide the several degrees of freedom of cartridge movement to allow the contours of the skin to be followed closely during shaving. While it is apparent that modifications and changes can be made within the spirit and scope of the present invention, it is our intention, however, only to be limited by the appended claims.

We claim:

1. A safety razor having a handle and a blade assembly mounted to the handle by an arrangement permitting movement of the blade assembly relative to the handle, characterised in that the mounting arrangement comprises several spring suspension devices disposed to provide support for the blade assembly at a plurality of discrete support locations so distributed that the blade assembly is movable relative to the handle with several degrees of freedom including (i) pivotal movement about a longitudinal axis, (ii) pivotal movement about a transverse axis, and (iii) translational movement in a downward direction substantially perpendicular to the plane defined by the longitudinal and transverse axes, and wherein first and second of said discrete support locations are spaced lengthwise of the blade assembly and a third of said discrete support locations is spaced transversely from an axis connecting said first and second discrete support locations.

2. A safety razor according to claim 1, wherein the spring suspension devices urge the blade assembly to a rest position in a predetermined plane from which said blade assembly is movable according to any of the movements (i) to (iii) or any combination of said movements.

3. A safety razor according to claim 1, wherein there are four suspension devices arranged in first and second opposed pairs, said first pair being disposed at first and second of said discrete support locations along a first axis extending lengthwise of the blade assembly, and said second pair being disposed at third and fourth of said discrete support locations along a second axis extending lengthwise of the blade assembly, said second axis being spaced transversely from said first axis.

4. A safety razor according to claim 3, wherein the discrete support locations are adjacent respective corners of a frame of the blade assembly.

5. A safety razor according to claim 1, wherein the suspension devices consist of spring members.

6. A safety razor according to claim 5, wherein the spring members are bow springs.

7. A safety razor according to claim 5, wherein the spring members are torsion springs.

8. A safety razor according to claim 1, wherein the suspension devices are directly connected to a blade assembly frame.

9. A safety razor having a handle and a blade assembly mounted to the handle by an arrangement permitting movement of the blade assembly relative to the handle, characterised in that the mounting arrangement comprises several spring suspension devices disposed to provide support for the blade assembly at a plurality of discrete support locations so distributed that the blade assembly is movable relative to the handle with several degrees of freedom including (i) pivotal movement about a longitudinal axis, (ii) pivotal movement about a transverse axis, and (iii) translational movement in a downward direction substantially perpendicular to the plane defined by the longitudinal and transverse axes, and wherein the suspension devices comprise slidably mounted struts pivotally coupled to the blade assembly and compression springs coaxial with the struts.

* * * * *